US011163265B2

(12) United States Patent
Della Santa

(10) Patent No.: US 11,163,265 B2
(45) Date of Patent: Nov. 2, 2021

(54) WATCH CASE COMPRISING A ROTATING BEZEL

(71) Applicant: Montres Breguet S.A., L'Abbaye (CH)

(72) Inventor: Richard Della Santa, La Chaux-de-Fonds (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 16/819,423

(22) Filed: Mar. 16, 2020

(65) Prior Publication Data

US 2020/0301365 A1 Sep. 24, 2020

(30) Foreign Application Priority Data

Mar. 18, 2019 (EP) ..... 19163518

(51) Int. Cl.
*G04B 19/28* (2006.01)
*G04B 37/00* (2006.01)

(52) U.S. Cl.
CPC ..... *G04B 19/283* (2013.01); *G04B 37/0008* (2013.01)

(58) Field of Classification Search
CPC .... G04B 19/283; G04B 37/0008; G04B 3/08; G04B 27/08; G04B 19/16; G04B 19/223; G04B 19/28; G04B 19/238; G04B 29/286; G04C 3/005; G04G 21/00; G04G 17/04; G04G 17/08; G04G 21/08
USPC ..... 368/295
See application file for complete search history.

(56) References Cited

U.S. PATENT DOCUMENTS 4,244,044 A * 1/1981 Olsson ..... G04B 3/08 368/224
4,815,053 A 3/1989 Dal Busco
5,319,617 A * 6/1994 Sonoda ..... G04B 19/286 368/294
5,654,941 A * 8/1997 Joss ..... G04B 19/283 368/295
5,822,279 A * 10/1998 Cuche ..... G04B 19/286 368/295

(Continued)

FOREIGN PATENT DOCUMENTS

CH 547 518 A 3/1974
CH 708 959 A2 6/2015

(Continued)

OTHER PUBLICATIONS

European Search Report dated Sep. 19, 2019 in European Application 19163518.4 filed Mar. 18, 2019 (with English Translation of Categories of Cited Documents), 3 pages.

(Continued)

*Primary Examiner* — Edwin A. Leon
(74) *Attorney, Agent, or Firm* — Oblon, McClelland, Maier & Neustadt, L.L.P.

(57) ABSTRACT

A watch case including a rotating bezel and a middle part, the bezel being mounted such that it is capable of moving in rotation on the middle part, the bezel and the middle part defining therebetween an annular chamber internally including a device for creating a friction torque between the bezel and the middle part, the device including a compressing member and a braking element, the compressing member exerting a compressive stress on the braking element under the effect whereof the braking element is pressed against the bezel.

11 Claims, 4 Drawing Sheets

(56) References Cited

U.S. PATENT DOCUMENTS

| | | | | |
|---|---|---|---|---|
| 6,616,329 | B1 * | 9/2003 | Sasaki | G04B 19/283 368/294 |
| 8,777,480 | B2 * | 7/2014 | Silvant | G04B 19/286 368/295 |
| 10,534,324 | B2 * | 1/2020 | Chung | G04G 17/04 |

FOREIGN PATENT DOCUMENTS

| | | | |
|---|---|---|---|
| CN | 103926825 | A | 7/2014 |
| CN | 104834206 | A | 8/2015 |
| CN | 104854518 | A | 8/2015 |
| CN | 105988358 | A | 10/2016 |
| CN | 107656434 | A | 2/2018 |
| CN | 108027591 | A | 5/2018 |
| EP | 1 598 711 | A2 | 11/2005 |
| JP | 48-21578 | A | 6/1973 |
| JP | 61-174687 | U | 10/1986 |
| JP | 7-311286 | A | 11/1995 |
| JP | 2006-126017 | A | 5/2006 |
| JP | 4617828 | B2 | 1/2011 |
| JP | 6453949 | B2 | 1/2019 |

OTHER PUBLICATIONS

Notice of the Reason for Refusal dated Feb. 16, 2021 in Japanese Patent Application No. 2020-040558 (with English language translation), 7 pages.

Combined Chinese Office Action and Search Report dated Mar. 3, 2021 in corresponding Chinese Patent Application No. 202010182369.4 (with English Translation and English Translation of Category of Cited Documents); 15 pages.

Office Action dated Jun. 8, 2021 in corresponding Japanese Patent Application No. 2020-040558 (with English Translation), 6 pages.

* cited by examiner

WATCH CASE COMPRISING A ROTATING BEZEL

CROSS-REFERENCE TO RELATED APPLICATION

This application claims priority to European Patent Application No. 19163518.4 filed on Mar. 18, 2019, the entire disclosure of which is hereby incorporated herein by reference.

TECHNICAL FIELD

The present invention relates to a watch case of a timepiece having a middle part and a bezel capable of rotating on the middle part, said case comprising a device for creating a friction torque inserted between the bezel and said middle part.

The invention also relates to a watch having such a case provided with this device.

TECHNOLOGICAL BACKGROUND

In the prior art, external rotating bezels generally equip diving watches, or watches indicating the global time, and are used in numerous applications. Generally speaking, rotating bezels are grooved at the periphery thereof so as to be easy to grasp. Moreover, they must be mounted on a middle part of a watch case so as to rotate consistently without providing too high resistance, yet also without moving unintentionally. The rotating bezel must thus be mounted such that it procures consistent friction between the parts of the same series, in order to allow for rational manufacture that does not require touching up each part. Moreover, the fastening device must be easy to install and provide sufficient guarantees preventing the bezel from coming away during an impact or unintentional friction, as well as from being removed.

A rotating bezel is known to conventionally be mounted on the middle part by way of a metal wire that is corrugated or has leaves, engaged simultaneously in grooves of the bezel and of the part of the middle part supporting same. When installing the bezel, the metal wire undergoes elastic deformations which change the lengthwise development thereof. The guarantee for preventing the bezel from coming away is not always satisfactory; moreover, the correct positioning of these known devices is often delicate.

Rotating bezels are also known, which are connected to a fixed part of the case by a flat elastic ring, radially split at a point along the circumference thereof and the outer edge whereof in addition to the inner edge whereof are engaged in grooves made in the rotating bezel and the part supporting same. Such an assembly ensures the sufficiently precise guiding of the rotating bezel, however requires an additional device which locks the two ends of the ring in position relative to one of the parts of the assembly.

SUMMARY OF THE INVENTION

The purpose of the present invention is to overcome the aforementioned and other problems by improving the known assembly operations for assembling the rotating bezel on the middle part of the watch case such that they better meet the various requirements stemming from the use of this bezel.

For this purpose, the present invention relates to a watch case comprising a rotating bezel and a middle part, the bezel being mounted such that it is capable of moving in rotation on the middle part, said bezel and said middle part defining therebetween an annular chamber internally comprising a device for creating a friction torque between the bezel and the middle part, said device comprising a compressing member and a braking element, the compressing member exerting a compressive stress on the braking element under the effect whereof said braking element is pressed against the bezel.

Thanks to these features, the device for creating a friction torque between the bezel and the middle part thus contributes to ensuring constant, consistent and robust braking by friction, throughout the life of the watch, which thus allows the bezel to rotate in a consistent manner without procuring too high resistance, yet also without moving unintentionally.

In other embodiments:

- the compressing member is an O-ring type gasket;
- the braking element is a polyoxymethylene ring;
- the shore hardness and/or the section of the compressing member contributes to defining the compressive stress applied to the braking element;
- the annular chamber is formed by a groove made in an outer wall of the middle part and by a portion of an inner wall of the bezel;
- the compressing member is defined such that it is in contact with both the groove of the annular chamber and the braking element;
- the braking element is defined such that it is in contact with both the portion of the annular chamber and the compressing member;
- the braking element comprises a friction face intended to engage with a contact area of a portion of the annular chamber; and
- the watch case comprises two grooves respectively defined in the middle part and the bezel while being arranged such that they face one another and intended to comprise a spring used for assembling the bezel to the middle part.

The invention also relates to a watch comprising such a case.

BRIEF DESCRIPTION OF THE FIGURES

The invention will be described in more detail hereinafter using the accompanying drawings, given by way of examples that are in no way limiting, wherein.

DETAILED DESCRIPTION OF THE INVENTION

The present invention will now be described in connection to a watch case 1, in particular a sealed case. Such a watch case 1 is preferably comprised in a wristwatch. It goes without saying that this example is provided for illustrative purposes only and that the present invention can be applied to any type of timepiece, such as a pocket watch.

Figure 1:
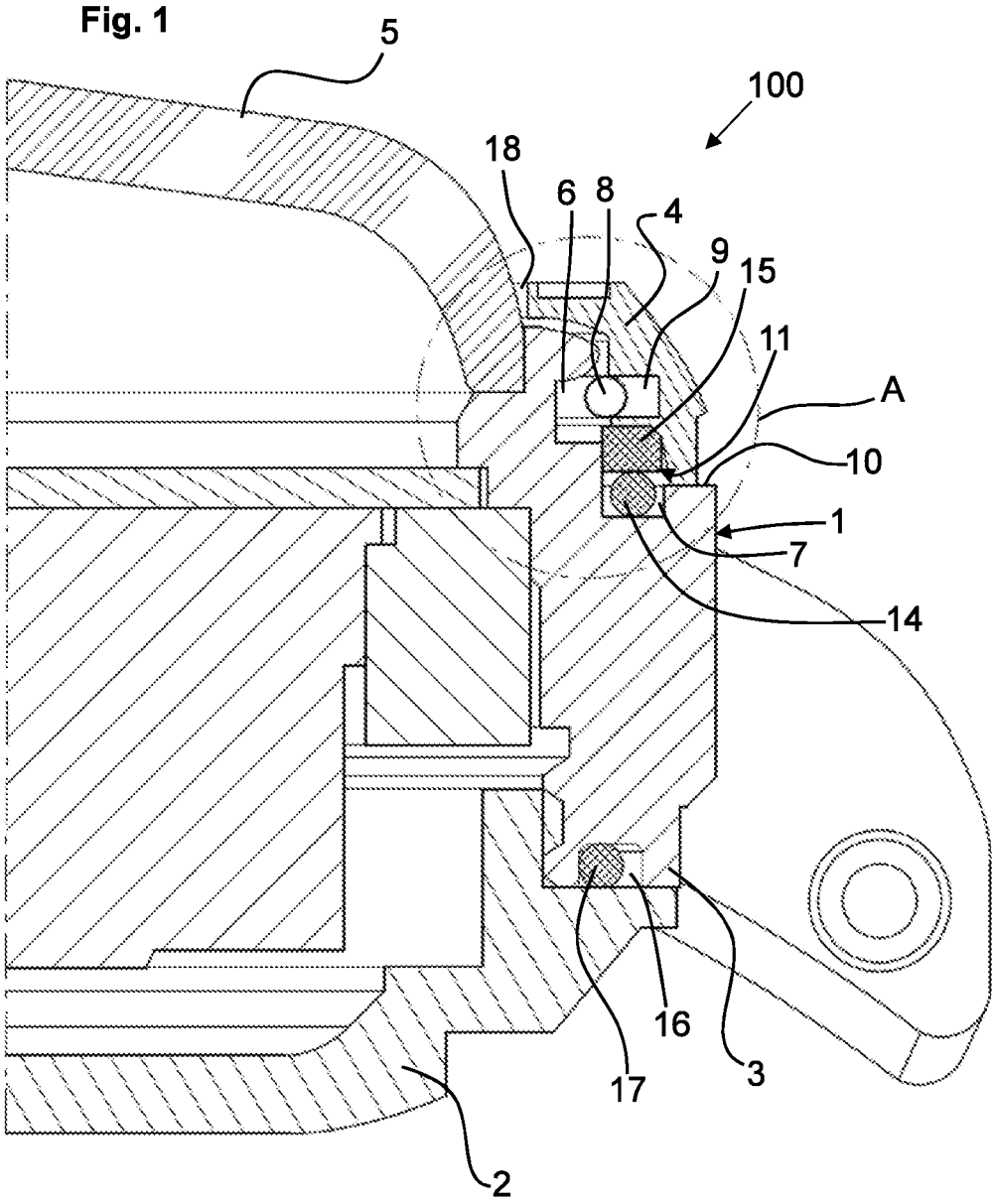
FIG. 1 is a partial sectional view of a watch case according to the present invention.
Figure 2:
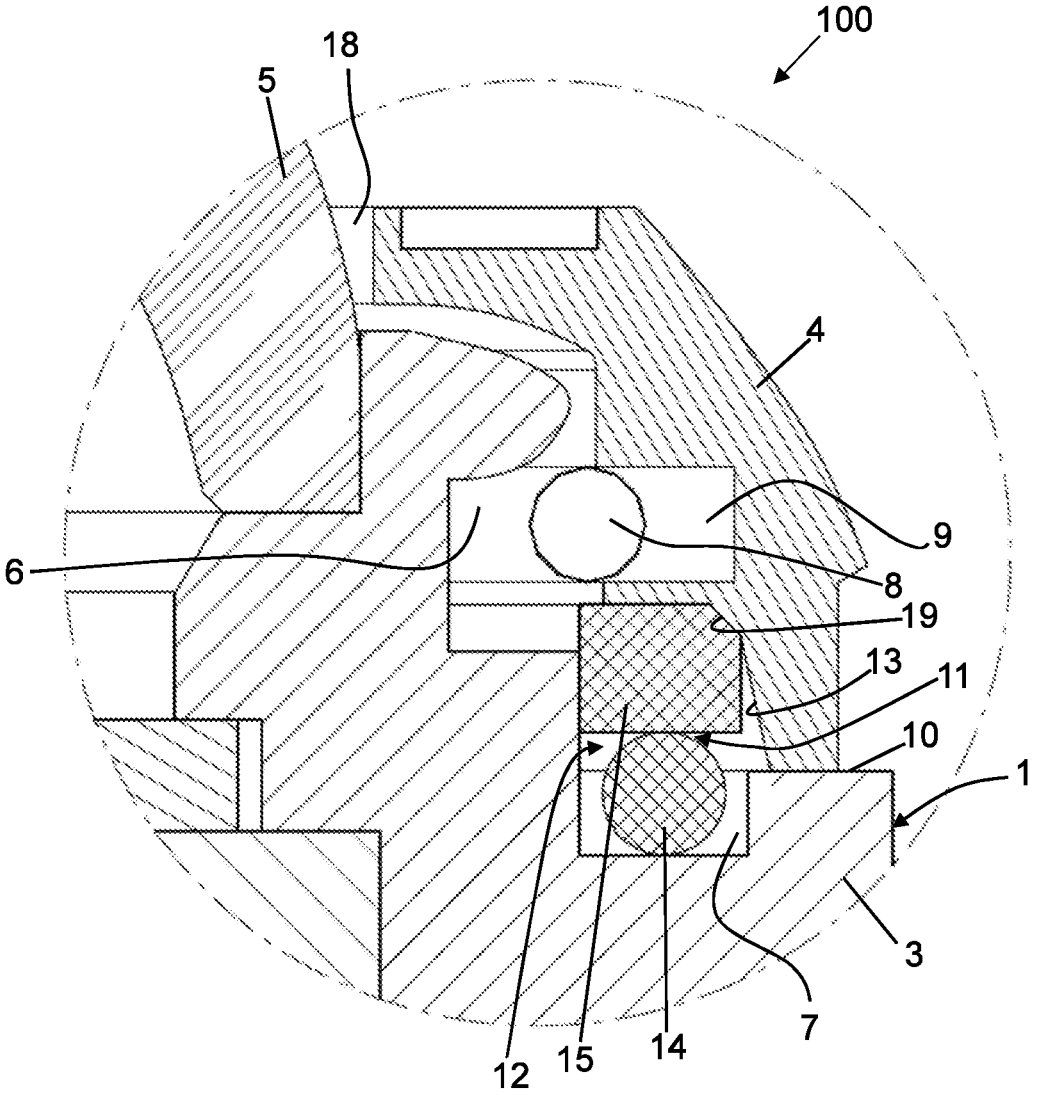
FIG. 2 is a more large-scale view of a part A of this case shown in FIG. 1, according to the present invention.
Figure 3:
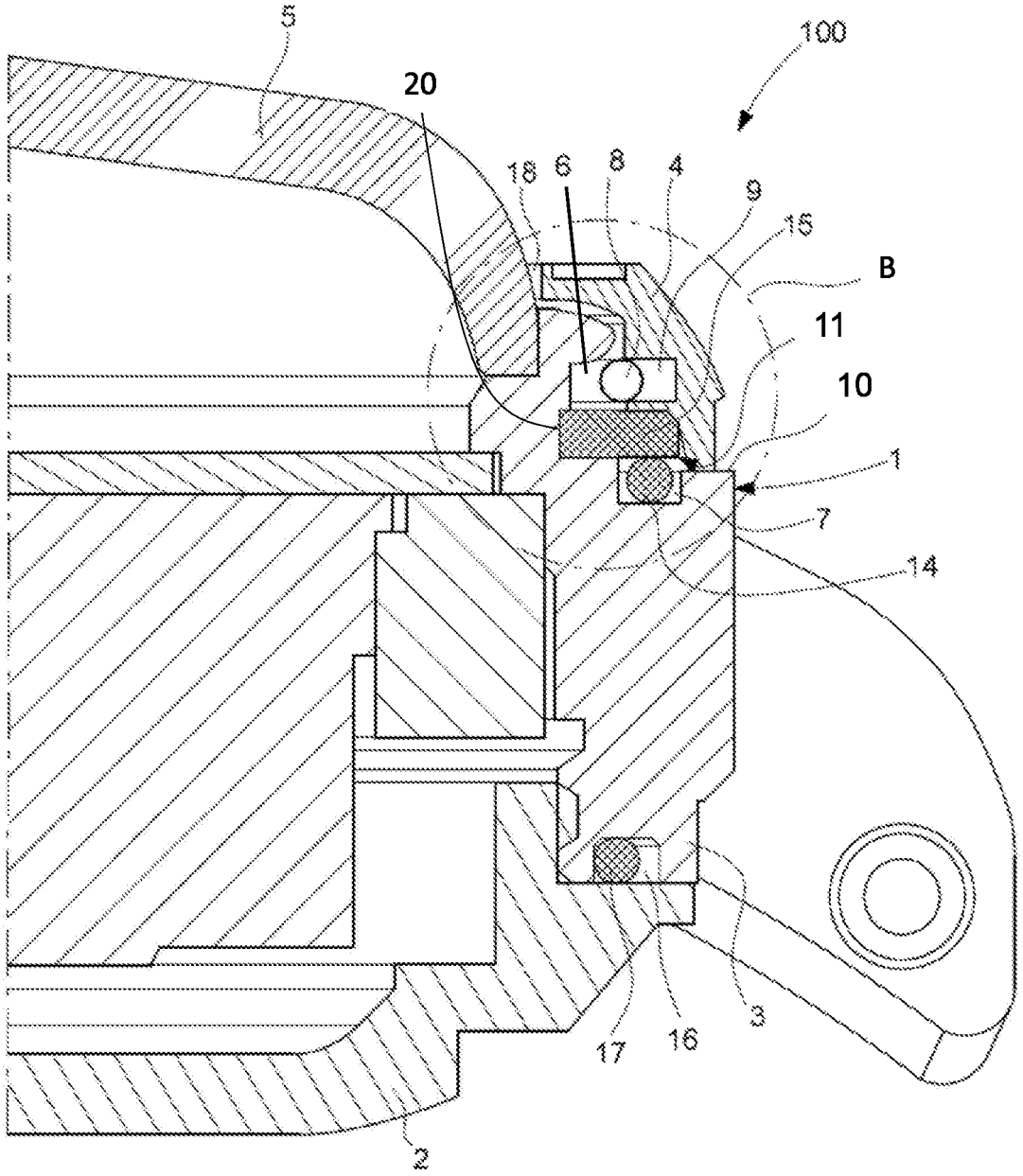
FIG. 3 is a partial sectional view of an alternative embodiment of the watch case according to the present invention.
Figure 4:
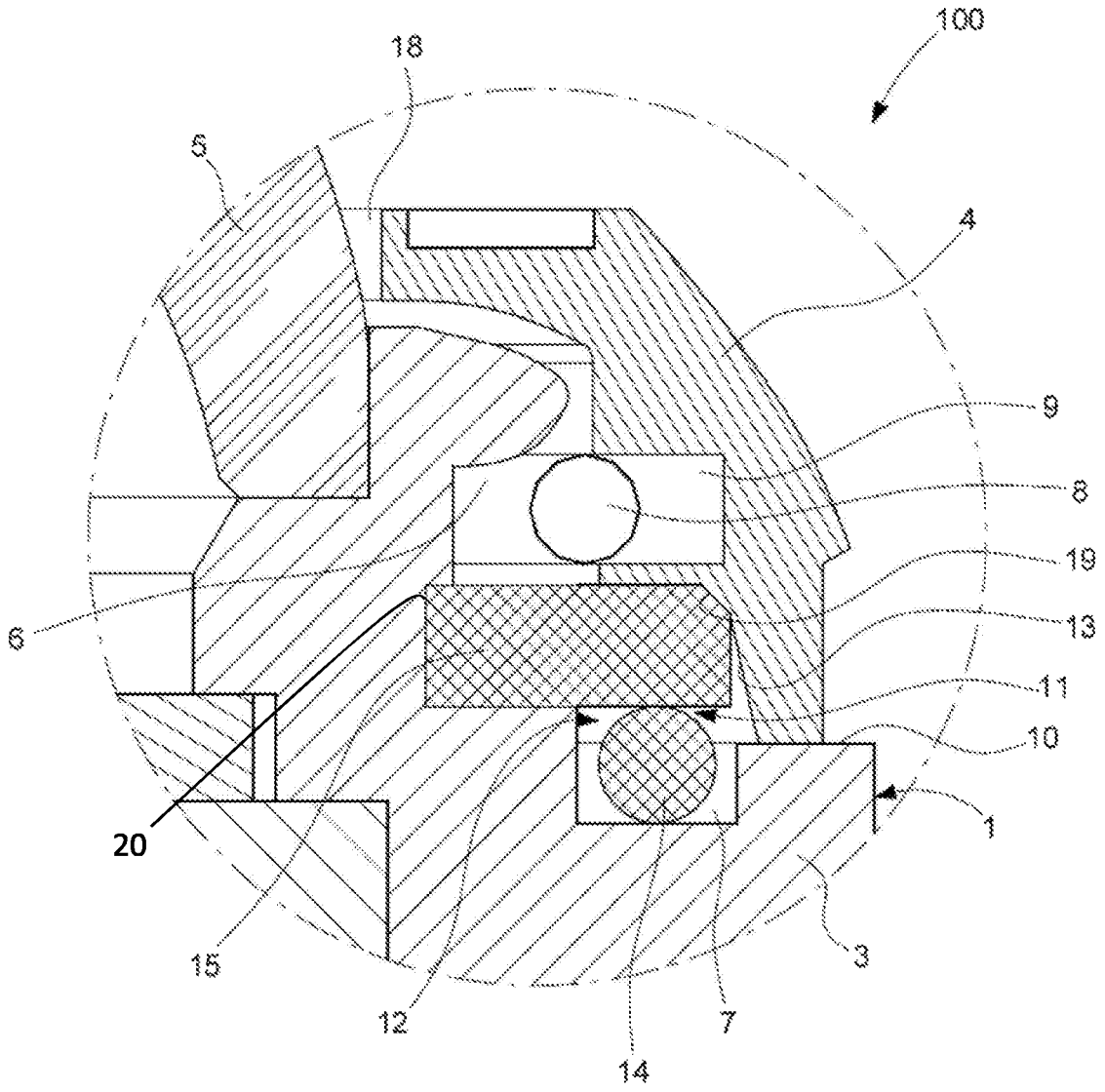
FIG. 4 is a more large-scale view of a part B of this alternative embodiment of the case shown in FIG. 3, according to the present invention.

In FIGS. 1, 2 and 3, this watch 100 comprises a case 1 designated as a whole by the general reference numeral 1, having a back 2 and an assembly formed by a middle part 3 and a bezel 4 mounted such that it rotates on the middle part 3. This middle part and this bezel can, for example, be made of steel, of a precious metal (gold, silver, platinum), of a precious metal-based alloy or even of ceramic, etc.

Such a middle part 3 includes an annular groove 16 defined on the outer wall thereof and which is positioned inside said case 1 facing an inner face of the back 2, said groove 16 comprising a gasket 17. The middle part 3 and this back 2 delimit a volume in which the different members of the watch 100 are housed. A glass/crystal 5 is fastened to the middle part 3 with the insertion of a gasket 18 between the glass 5 and said bezel 4.

The middle part 3 on which the bezel 4 is mounted such that it is capable of moving in rotation, has two annular grooves 6 and 7 intended for the assembly of the bezel 4 and defined in the outer wall of this middle part 3. The bezel 4 is mounted on the middle part 3 by way of a spring 8, for example a multi-leaf wire spring or polygonal spring engaging in the groove 6 of the middle part 3 as well as in a groove 9 of the bezel 4. The grooves bearing the reference numerals 6 and 9 are arranged such that they face one another and are respectively made in the cylindrical outer wall of the middle part 3 and in a cylindrical inner wall of the bezel 4. Thus, by way of this spring 8, the bezel 4 is pressed downwards against a shoulder 10 of the middle part 3.

The groove 7 of the middle part 3 comprises a part of a device for creating a friction torque 11 contributing to the assembly of the bezel 4 on this middle part 3. More specifically, this groove 7 is comprised within an annular chamber 12 of the watch case 1, which chamber 12, visible in FIG. 2, is defined between the bezel 4 and the middle part 3, in particular between the outer wall of the middle part 3 and the inner wall of the bezel 4.

This annular chamber 12 in which the device for creating a friction torque 11 is arranged, is thus formed by the groove 7 made in the outer wall of the middle part 3 and by a portion 13 of the inner wall of the bezel 4, this groove 7 and this portion 13 being arranged such that they face one another. It should be noted that this portion 13 comprises a contact area 19 intended to engage with a friction face of a braking element 15 of the device 11.

It should be noted with reference to FIG. 3 that in one alternative embodiment of the watch case 1, the device for creating a friction torque 11 is thus formed by the groove 7 and an annular groove 20, both made in the outer wall of the middle part 3, and by a portion 13 of the inner wall of the bezel 4. In this configuration, the braking element 15 is arranged in the groove bearing the reference numeral 20 such that the friction face thereof engages with the contact area 19 of the device 11. It should be noted that such a configuration procures the advantage of allowing the case 1 to be disassembled, in particular the bezel to be disassembled from the middle part, during which the braking element 15 and the compressing member 14 are held in position in the middle part 3.

In this configuration, the device for creating a friction torque 11 between the bezel 4 and the middle part 3 comprises a compressing member 14 and this braking element 15. This compressing member 14 is arranged in the groove 7 of the annular chamber 12 such that it is in contact with both the bottom of the groove 7 or the walls thereof, and the braking element 15. The braking element 15 is defined such that it is in contact with both the contact area 19 of the portion 13 of the annular chamber 12 and the compressing member 14. In this context, this compressing member 14 is arranged in the annular chamber 12 so as to exert a compressive stress on the braking element 15 under the effect whereof said braking element 15 is pressed against the bezel 4. In other words, it is understood that in this configuration, braking by friction against the rotation of the bezel 4 is carried out by means of the compressing member 14 disposed in the groove 7 which makes a compressive contact with the braking element 15, itself in frictional contact with the contact area 19 of the portion 13 of the bezel 4. Such a contact area 19 of the portion 13 is defined so as to engage with the braking element 15 of the device 11.

It should be noted that in this device 11, the compressing member 14 and the braking element 15 must have at least one different feature, for example relative to the material from which they are made, the elasticity thereof, the tensile strength thereof, the ultimate compressive strength thereof, the resistance thereof to wear, the resistance thereof to chemicals, the dimensional stability thereof, the creep strength thereof, the coefficient of friction thereof, or the abrasion resistance thereof, etc.

In this context, the compressing member 14 is an O-ring gasket having a circular section/profile. The O-ring gasket is held compressed inside the groove 7 of the annular chamber 12, this groove 7 can thus have a profile similar to that of this gasket, for example a groove 7 with a circular profile or more conventionally and as shown in the figures, with a rectangular profile. In one specific embodiment, the material used to form this O-ring gasket comprises, for example, rubber, silicone, nitrole or any other elastomer made by the Isoswiss™ and Isochron™ brands. It should be noted that the compressing member has a very high abrasion resistance.

In this device 11, the braking element 15 is a ring. This braking element 15 can be made of a polymer, in particular polyoxymethylene, more commonly known by the acronym "POM" or by the name "Acetal". This braking element 15 is, for example, a one-piece part but can also be formed by a plurality of parts engaging with one another. This braking element 15 comprises the friction face intended to engage with the contact area 19 of the portion 13 of the inner wall of the bezel 4, this face and this portion 13 both having complementary profiles. In other words, the contact area 19 almost perfectly takes on the shape of the friction face of the braking element 15. This braking element 15 comprises a section, the shape whereof is essentially similar to that of a quadrilateral.

Such a braking element preferably has:

- a modulus of elasticity of 2,500 to 3,500 GPa, greater than that of the compressing member 14, which lies in the range 0.001 to 0.1 GPa, and which preferably corresponds to a hardness of 60 to 80 shore and a maximum compression of 20%;
- a low coefficient of friction of 0.25 to 0.60 (in particular on steel), which does not vary under the following conditions: dry, wet, oiled;
- good resistance to wear of 0.75 u/km and defined by the practical application which has produced good results, in particular when the braking element is made of POM and the bezel is made of steel.

It should be noted as a whole that the braking element has good fatigue strength, good resistance to chemicals, good creep strength and good resistance to temperatures, in particular when made of POM.

Thus, the compressing member 14 has been observed to exert a compressive stress, also known as a compression ratio on the braking element 15. This compression ratio of the compressing member 14 can be freely adapted by adjusting the Shore hardness or the section of this compressing member 14. This compression ratio of the compressing member 14 also contributes to determining the rotation torque of the bezel 4 or even the intensity of the friction torque between the bezel 4 and the middle part 3.

It goes without saying that the present invention is not limited to the example shown but that various alternatives and modifications that may be apparent to a person skilled in the art can be made thereto.

The invention claimed is:

1. A watch case comprising:

a rotating bezel and a middle part, the bezel being mounted such that the bezel is capable of moving in rotation on the middle part, and a spring positioned between the bezel and the middle part to mount the bezel on the middle part, said bezel and said middle part defining therebetween an annular chamber internally comprising a device for creating a friction torque between the bezel and the middle part, said device comprising a compressing member and a braking element, the compressing member exerting a compressive stress on the braking element under the effect whereof said braking element is pressed against the bezel, said device being separate from the spring.

2. The case according to claim 1, wherein the compressing member is an O-ring type gasket.

3. The case according to claim 1, wherein the braking element is a polyoxymethylene ring.

4. The case according to claim 1, wherein the shore hardness and/or the section of the compressing member contributes to defining the compressive stress applied to the braking element.

5. The case according to claim 1, wherein the annular chamber is formed by a groove made in an outer wall of the middle part and by a portion of an inner wall of the bezel.

6. The case according to claim 1, wherein the compressing member is defined such that it is in contact with both the groove of the annular chamber and the braking element.

7. The case according to claim 1, wherein the braking element is defined such that it is in contact with both the portion of the annular chamber and the compressing member.

8. The case according to claim 1, wherein the braking element comprises a friction face intended to engage with a contact area of a portion of the annular chamber.

9. The case according to claim 1, wherein the case comprises two grooves respectively defined in the middle part and the bezel while being arranged such that they face one another and comprise the spring used for assembling the bezel to the middle part.

10. A watch comprising a case according to claim 1.

11. The case according to claim 1, wherein the spring is positioned to press the bezel downwards directly against a shoulder of the middle part.

* * * * *